United States Patent [19]

Eddleman

[11] 4,148,700

[45] Apr. 10, 1979

[54] METHOD FOR PURIFYING THE LIQUOR OF A GALVANIZING PROCESS PLANT AFTER CONTAMINATION

[75] Inventor: William L. Eddleman, Houston, Tex.

[73] Assignees: David B. Dean, Houston; Douglas B. Hayden, Jr., Beaumont, both of Tex.; part interest to each

[21] Appl. No.: 912,338

[22] Filed: Jun. 5, 1978

Related U.S. Application Data

[63] Continuation of Ser. No. 732,479, Oct. 14, 1976, abandoned, which is a continuation of Ser. No. 582,838, Jun. 2, 1975, abandoned.

[51] Int. Cl.[2] ..... C25B 1/22; C25C 1/06; C25B 13/02; C25B 13/08

[52] U.S. Cl. ..... 204/130; 204/104; 204/112; 204/295

[58] Field of Search ..... 204/104, 130, 295, 112

[56] References Cited

U.S. PATENT DOCUMENTS 3,679,538 7/1972 Druin et al. ..... 161/159

*Primary Examiner*—R. L. Andrews
*Attorney, Agent, or Firm*—Sigalos & Levine

[57] ABSTRACT

A method of purifying a galvanizing and/or metal cleaning plant pickle liquor to enable repetitive re-use of the acid which includes the steps of placing a cathode and an anode in the spent acid (pickle liquor) and passing a DC current therethrough. The cathode and anode are separated in the pickle liquor solution by a permeable diaphragm which permits transfer therethrough of the metal ions and the acid anions. Metal molecules in the liquor such as iron, zinc, etc., are recovered upon their adherence to the cathode. The recovery is about 80 to 90 percent of the total metal ion content on that side of the diaphragm. The iron in solution is removed from that side of the tank and it is transferred to a precipitator tank. There, a neutralizing base is added to precipitate the remaining iron typically as a ferric hydroxide out of the tank. Pickle liquor in the form of the spent acid and metal ions is continuously added on the cathode side of the diaphragm while purified acid flow is recovered from the anode side of the membrane for return for re-use. The diaphragm is able to pass ions stripped of the water of hydration.

11 Claims, No Drawings

METHOD FOR PURIFYING THE LIQUOR OF A GALVANIZING PROCESS PLANT AFTER CONTAMINATION

This disclosure is a continuation of application Ser. No. 732,479, filed Oct. 14, 1976, now abandoned which is, in turn, a continuation of application Ser. No. 582,838 filed June 2, 1975, now abandoned.

BACKGROUND OF THE INVENTION

In galvanizing plants, a vessel for cleaning many forms of steel is charged with an acid. Normally, the acid has a pH of about 1. Typically a strong acid is used and the most common acid is sulfuric acid. The vessel of container is heated to something less than boiling. Elevation of the temperatures elevates the chemical activity occuring in the tank. Prior to galvanization, the steel to be coated with zinc must be first cleaned. The steel must be cleaned of rust, dirt, scale, and other materials. After cleaning, the galvanizing process can then proceed. The zinc coating adheres successfully on a clean surface. For this reason, pre-cleaning of the steel must occur before galvanization.

Sometimes, the galvanization process will not be carried on perfectly and as a consequence, the partially galvanized steel must be cleaned. Thus it is necessary to return the incorrectly galvanized steel to the cleaning tank where it will be stripped of the zinc coating thereon.

After some period of time, the acid cleaning tank becomes heavily laden with ions of metal molecules. This of course reduces the effectiveness of the acid bath. At a point in time when the acid bath is substantially contaminated, it is no longer able to clean the steel. It has been heretofore necessary to dump all of the acid from the cleaning tank and replace it with a fresh batch of acid. However, in recent years with concern about the environment rising, it has become exceedingly difficult to dispose of several thousand gallons of spent acid. While the acid may not be usable commercially at this juncture it remains a strong acid and most locales forbid the dumping of a strong acid laden with metal ions into the sewer system. One alternative is to truck the spent or contaminated acid away to an authorized disposal facility where it might be combined with available waste bases for neutralization of the bases. As can be understood, disposal techniques are quite expensive.

The present invention provides a method whereby the spent or contaminated acid can be purified which enables it to be re-used. A tremendous savings in cost is achieved by avoiding disposal problems of the spent acid. An ecological advantage is also achieved by avoiding the pumping of the spent acid into sewers.

The present invention thus purifies and recovers the acid to be re-used indefinitely by cutting across interdisciplanary lines to take advantage of techniques from electro-chemistry, electro-dialysis, and more traditional wet chemistry which disciplines cannot in and of themselves solve this problem. This is done at the cost of electric power consumption. However, this cost is more than recovered by the recovery of purified acid which can be returned to the cleaning tanks. There is an additional benefit. The acid is used as mentioned above to clean metal plates and eventually becomes heavily laden with various metals. This method enables recovery of the metals which then have resale value primarily but not exclusively in the agricultural chemical market.

This achievement is noteworthy in that the recovery of purified acid and metal from the process more than covers the cost of operation.

SUMMARY OF THE INVENTION

The method of the present invention is directed to the purification of metal saturated pickle liquor from a galvanizing plant. The pickle liquor is spent acids which are heavily laden with various metal ions. The method of the present invention utilizes a separate tank. The tank is divided preferably down the center by a permeable diaphragm. The diaphragm has pores which pass metal ions in one direction and acid anions in the opposite direction but it does not pass water. It prevents passage of the water of hydration. An anode is placed on one side of the diaphragm and a cathode is placed on the other side. A DC current source is connected to the terminals and a current flow through the bath is established. Elemental metals collect and adhere to the cathode. Acid is concentrated and recovered at the anode. Thus, the impure pickle liquor is continually pumped to the vicinity of the cathode and purified acid is recovered from the anode side. This novel technique recovers far more than half of the metal at the cathode. The remaining liquid in that vicinity is transferred to a precipitating tank where at this juncture it is only a very mild acid (pH of about 5). Zinc Oxide waste known as "skimmings" can be introduced to raise the pH. A precipitating technique can then be used to recover all the remaining metal ions.

DESCRIPTION OF THE PREFERRED EMBODIMENT

The present invention is directed to a method for purification of spent acids typically recovered from a galvanizing plant. In its original state, the acid is normally a strong acid having a pH of about 1, and the most common acid is sulfuric acid. The acid is used to clean metal prior to or after galvanizing. Normally, the acid is used until it is contaminated by metal ions. The acid, on contamination with metal ions, eventually becomes unusable. The method of the present invention contemplates the purification and re-using of pickle liquor from a galvanizing plate.

the method of the present invention contemplates the following steps.

A cleaning tank of spent acid (hereinafter referred to as pickle liquor) typically having a pH of 1, but at this juncture loaded with metal ions, is preferably drained continuously. The tank might hold ten thousand gallons or more. A purification tank of about one thousand gallons is typically used although obviously it can be scaled upwardly or downwardly as desired. The purification tank is divided preferably into halves by a permeable diaphragm which extends above the surface. Many forms of acid resistant and permeable diaphragms are suitable, one such diaphragm being felted or non-woven polypropylene. It is necessary that they pass, with some efficiency, acid anions and metal ions. A typical diaphragm which is quite suitable for these purposes is manufactured by the Celanese Plastics Corporation and sold under the trademark "Celgard." This product by Celanese is open-celled microporous polymer (polypropylene) film disclosed and described in U.S. Pat. No. 3,679,538, which is inherently hydrophobic and specially processed to provide a pore structure which provides a barrier to water and is the preferred membrane. Membranes made of other olefins can also be used so long as they have the same pore and water barrier properties as the polypropylene film and U.S. Pat. No. 3,679,538, discloses that suitable olefins for this purpose are polyethylene, poly-3-methyl butene-1, and the like, and copolymers thereof. The films (membranes) have a reduced bulk density as compared to the bulk density of the corresponding films having no open-celled structure, a crystallinity of above about 30 percent, a pore size of less than 5,000 angstroms, and a nitrogen flux greater than 35.4 and are prepared, as discussed in U.S. Pat. No. 3,679,538, by the consecutive steps of cold stretching, hot stretching, and heat-setting a non-porous, crystalline, elastic film made of a polymer discussed above. The dimensions of the pores in the diaphragm are more than adequate to control ion movement between the two halves of the purification tank. The diaphragm has a typical pore size of about 40 angstroms width to about 400 angstroms in length. These dimensions are sufficient to enable the migration of metal ions and acid anions in the tank. This pore size also permits the movement of the other metals found in the pickle liquor such as zinc and so on. This diaphragm prevents the ion from migrating with the water of hydration affixed to the ion.

The preferred anode material is carbon and the preferred cathode material is steel or aluminum. On the cathode side of the tank, the spent acid, laden with metal ions, is introduced. A typical analysis at which continued use as a cleaning acid is not feasible shows roughly 6% ferrous sulfate and perhaps as high as 10% of free mineral sulfuric acid. Other metals, if present, typically are sulfates. The opposite (anode) side of the diaphragm is initially filled with water. The anode and cathode are then energized. Once an electric current is established, the acid anions transfer through the diaphragm to the side of the tank where the anode is located while the iron and other metal ions are electrically held in the vicinity of the cathode after being drawn toward the cathode. As a representative number, perhaps several thousand gallons of pickle liquor are continuously introduced on the cathode side. An approximately equal amount is removed daily after start up from the anode side.

The ratio of surface areas of the anode and cathode is roughly one to one. The DC voltage applied to the terminals is sufficient to obtain an adequate current flow and typically is only three or four volts in view of wiring resistance; higher voltages are acceptable.

The cathode collects, by adherence, the bulk of the metal in the spent acid. It is not economical however to remove all of the metal in this manner. A small percentage of the metal ions will remain in solution. A continuous flow of liquid from the cathode side is removed. Removal of this solution does not begin until after the process has continued from some period of time. The acid anion migration through the diaphragm raises the pH in the cathode side of the tank. Even though acid is being introduced with a pH ranging as low as 1, the cathode side will stabilize after a period of time somewhere around 4 or so. It is not mandatory that this pH be achieved, but, rather economic use of the equipment dictates that the process not be over extended to obtain a higher pH. In any case, when the pH desired is achieved, and the most desirable pH appears to be about 4, the mildly acidic liquid from the cathode side is removed in small volumes. The remaining small percentage of metal ions which were not removed by the cathode are carried away with this removed liquid. This liquid is then carried to a tank for some form of wet chemistry removal. The metal remaining can be removed by precipitation for instance. This liquid is reacted with a neutralizing base (preferably zinc ash scrap from the galvanizing kettle) and ferric hydroxide is precipitated out. Other trace metals are also recovered as hydroxides. This leaves water which serves as a makeup supply which is returned to the process tank. This water however is returned on the anode side. The precipitating process is preferably balanced in volume so that the volume of liquid removed is balanced by an equal amount of water which is restored to the process tank. However, the removal of metals occurs on the cathode side as mentioned above and the makeup water is restored on the anode side.

Neutralization and precipitation is a very acceptable process for removal of the final traces of the metal ions. However, it is also possible to use filteration or by any other suitable liquid-solids separation techniques. Centrifuging, for instance, is acceptable provided however, that the metals (typically iron) have converted to a less than soluable compound such as conversion from a ferrous salt to a ferric salt.

The start up of the present process is relatively easy to implement. The anode side of the process tank is filled with water. The pickle liquor is introduces on the cathode side. At the beginning, pure water will not pass a substantial electric current. Acid anion movement increases current flow. As additional pickle liquor is introduced, the acid anion movement and hence the current flow increases. In fact, the current flow increase indicates an increase in the transfer in the acid anions from the cathode side to the anode side. Eventually, the purification process of the present invention can be placed on line with a given cleaning tank where an appropriate portion of the pickle liquor in the tank is removed on a daily or even continuous basis and purified acid is added to the tank to stabilize the cleaning acid purity. At this juncture, the only acid which is additionally required in the galvanizing plant is make up acid to compensate for evaporation, drippage and the like.

The present invention is particularly economical in operation. As mentioned before, typically in the range of 70 to 80% or more of the metal ions in the pickle liquor are recovered in the vicinity of the cathode. They form a type of adherence coating thereon. This coating however is not to be confused with electroplating. Rather, it is depositation which may be termed a type of adherence. It flakes off easily. The metal is cohesive in and of itself but its bond to the cathode plate is not very good. This enables the operator to remove the cathode plates from time to time to clean the adherence away. On removal, a sharp blow administered by a hammer typically will flake off a small portion of the coatings thereon. Eventually, the coatings become so thick that the electrical resistance encountered by the current flow from the cathode and through the metal adherence is in fact a detriment to the continued economical use of the process and creates neutral spots in the cathode plate thereby tending to retard or slow metal adherence. At this juncture, the adherence is too thick. The cathode shold be removed prior to this and the metal adherence thereon mechanically removed from it and a clean cathode placed in the circuit.

Generally, the anode plates do not show any deleterious effect from continued exposure to the acid.

The present method is particularly economical to use. It provides a benefit to cost ratio which is about equal or better. That is to say, the basic coat of use is the electric poser consumed by the apparatus. It appears based on representative prices that it provides benefits nearly equal the cost of the electric power. The direct benefits are the recovery of substantially purified acid. In addition, the metal which is recovered from the process can be sold. A third and indirect benefit of the method of the present invention is the avoidance of disposal problems. Disposal of many thousands of gallons of pickle liquor is exceedingly difficult. It is quite expensive also. The method of the present invention thus is preferably teamed with tanks which are permanently charged with acid and total recharging is avoided substantially for the life of the plant. Makeup acid is not necessary other than to replace the loss due to drippage and evaporation.

The foregoing is directed to the method of the present invention but the scope thereof is determined by the claims which follow.

I claim:

1. A method of removing metallic and acid ions from the liquor of a pickling or metal cleaning tank after it has been used and which has a pH of strong acid comprising the steps of passing a DC current through a pair of spaced current electrodes immersed in said liquor which are separated by an ionic permeable microporous polymer diaphragm dividing the tank of liquor into two parts and which diaphragm permits cations and anions to pass therethrough and which diaphragm is inherently hydrophobic and specially processed to provide a pore structure which blocks the movement of water molecules therethrough, including water of hydration, and forming a removable metallic deposit at the cathode and a substantially purified acid on the anode side of the diaphragm, the current flow through the diaphragm being by ionic movement.

2. The method of claim 1 wherein the electrods are plates which are connected to a DC voltage source of about three to four volts.

3. The method of claim 1 wherein the anode side of the tank is initially filled with water and the liquor is initially introduced into the cathode side of the tank.

4. The method of claim 1 wherein the metal ions of the pickle liquor in the vicinity of the cathode are removed as a solid and any remaining metal ions in solution are removed by a subsequent removal step.

5. The method of claim 1 wherein the metallic deposit formed at the cathode is permitted to accumulate until its presence at the cathode drops the current flow through the cathode.

6. The method of claim 1 wherein the current flow ranges upwardly from zero to a limit determined by heating of the cathode.

7. The method of claim 1 wherein the metallic deposit is mechanically removed from the cathode.

8. The method of claim 1 wherein the acid is sulfuric acid and the sulfate ions pass through the membrane to the anode side of the tank.

9. The method of claim 1 wherein said diaphragm is a hydrophobic, open-celled, microporous polypropylene film.

10. The method of claim 1 wherein said diaphragm has elongate pores having a size of about 40 by 400 angstroms.

11. The method of claim 1 wherein said diaphragm is formed of pores of about 40 angstroms which size enables acid and metal ions to pass bidirectionally therethrough.

* * * * *